US005472122A

United States Patent [19]

Appleby

[11] Patent Number: 5,472,122

[45] Date of Patent: Dec. 5, 1995

[54] DISPENSING VALVE WITH VENTING

[76] Inventor: Paul Appleby, 557 Melita Crescent, Toronto, Ontario, Canada, M6G 3Y7

[21] Appl. No.: 320,724

[22] Filed: Oct. 11, 1994

[51] Int. Cl.[6] ..... B65D 37/00

[52] U.S. Cl. ..... 222/212; 222/494

[58] Field of Search ..... 222/212, 215, 222/481, 484, 490, 494

[56] References Cited

U.S. PATENT DOCUMENTS

| | | | |
|---|---|---|---|
| 4,420,101 | 12/1983 | O'Neill | 222/494 |
| 4,506,809 | 3/1985 | Corsette | 222/494 |
| 4,513,891 | 4/1985 | Hain et al. | 222/494 |
| 4,728,006 | 3/1988 | Drobish et al. | 222/494 |
| 5,033,655 | 7/1991 | Brown | 222/494 |
| 5,037,005 | 8/1991 | Appleby et al. | 222/494 |

*Primary Examiner*—Andres Kashnikow
*Assistant Examiner*—Philippe Derakshani
*Attorney, Agent, or Firm*—Mark B. Eisen

[57] ABSTRACT

A dispensing valve for a resiliently deformable container includes a flange diaphragm having a sealing surface abutting a seating surface surrounding a dispensing opening in the cap. The flange diaphragm is retained against the seating surface at specific points, leaving portions of the flange diaphragm free to deform away from the seating surface. Thus, after the dispensing operation as the walls of the container try to return to their rest position, air can ingress into the container through the dispensing opening by forcing portions of the flange diaphragm away from the seating surface, to allow for quick and efficient venting of the container.

17 Claims, 3 Drawing Sheets

DISPENSING VALVE WITH VENTING

FIELD OF THE INVENTION

This invention relates to dispensing valves. In particular, this invention relates to a dispensing valve for use with a resiliently deformable container, wherein the dispensing valve provides improved means for permitting an ingress of air into the container thus allowing the container to return to its undeformed shape after being squeezed.

BACKGROUND OF THE INVENTION

Resiliently deformable containers, often called "squeeze bottles", are in widespread use for a variety of fluid products for both home and industrial use. A typical deformable container rests on a flat bottom, and has a spout on top which may include any one of a number of available sealing arrangements. The fluid contents of the bottle are dispensed by inverting the bottle and squeezing it, reducing the effective interior space within the bottle and thus forcing the contents out of the spout.

In recent years there have been developed deformable dispensing containers which are inverted, i.e., in which the spout is located on or about the base of the bottle. An example of such a container is found in U.S. Pat. No. 5,037,005 issued Aug. 6, 1991, in which the spout is located on an inclined wall of the container adjacent to its base. The primary advantage of such a design, particularly in the case of viscous contents, is that the contents of the bottle are immediately available for dispensing through the spout, as opposed to an ordinary upright bottle in which the user inverts the bottle and then must wait until the contents flow toward the spout under the influence of gravity before the contents can be dispensed.

With the availability of inverted dispensing bottles there has arisen a need for a spout which is self-sealing. It is inconvenient to utilize manually closable sealing means on a spout in the case of an inverted dispenser, where immediate dispensing is one of its most attractive features. A self-sealing spout avoids this problem, but the design of a self-sealing spout can be particularly difficult to accomplish. Essentially, the spout must open and allow an egress of the fluid contents of the container under the pressure of manual squeezing, but must completely close so that the contents of the container do not continually leak out of the spout when the container is not being squeezed.

Moreover, venting in manually closeable spouts used in an inverted dispenser is typically inadequate. Because the contents in an inverted dispenser are immediately available for dispensing, the container may require an aperture that is larger than what would be necessary in a conventional dispensing bottle for contents of similar viscosity. Although the larger aperture may help venting, it will result in messy and poorly controlled dispensing.

One solution that has been proposed is described in U.S. Pat. No. 4,728,006 issued Mar. 1, 1988, which is incorporated herein by reference. The valve described in this patent comprises a horizontal flange adapted to be secured between the lip of an inverted bottle spout and a cap, and a diaphragm portion comprising an inwardly concave resilient dome having one or more slits in or about its apex. Because the dome is inwardly concave, when the bottle is in the rest position the pressure of the fluid contents of the bottle force the edges of the slit together. When the bottle is squeezed, the pressure becomes sufficient to force the diaphragm dome into an outwardly convex position, at which point the compressive force on the fluid forces the edges of the slit apart and the fluid contents of the bottle flow out of the slit. When the squeezing pressure is released the dome returns to its original concave position. This valve has proved to be very effective at selectively permitting the contents of a container to be dispensed without any leakage when the container is at rest.

However, the valve described in U.S. Pat. No. 4,728,006, although it dispenses fluid contents effectively, has very poor "venting", i.e., permitting an ingress of air back into the bottle once the squeezing force has been released, which allows the bottle to return to its original undeformed shape. In order to prevent leakage through the diaphragm when the bottle is at rest, the edges of the fluid egress slit must be designed to be forced together until the bottle is squeezed. As noted above the pressure of the fluid contents on the dome in its concave rest position force the edges of the slit together. This presents a considerable advantage in terms of preventing unwanted leakage from the bottle, but results in a significant disadvantage in the ability of the bottle to vent.

Particularly where a viscous fluid is being dispensed, once the squeezing pressure has been released the ingress of air through the slit is insufficient, and the bottle thus remains deformed for considerably longer than it should. This presents a hindrance when large amounts of fluid are desired, since the user must wait for the bottle to slowly return to its rest condition after each squeeze before the bottle can be squeezed again to dispense more fluid. Furthermore, the deformed bottle is not symmetrical in shape, and in some cases may not be stable and free-standing in a deformed condition, forcing the user to wait until the bottle has vented before replacing it on a table or shelf. Over time the bottle becomes permanently deformed as the walls become concave, so that it becomes increasingly difficult to squeeze the bottle and dispense its contents.

Thus, the container described in U.S. Pat. No. 4,728,006 is required to be made of certain materials, and shaped within certain design constraints, so that the walls have a very strong "return" or "memory", thus ensuring proper venting with viscous fluids.

SUMMARY OF THE INVENTION

The present invention overcomes these disadvantages by providing a valve which allows fast and efficient venting following the squeezing of a resilient deformable container. The venting means provided by the invention permits the formation of large air bubbles, which rise through liquid faster than smaller air bubbles, particularly in the case of a viscous fluid or gel. In a preferred embodiment the invention is utilized with a self-sealing valve, such as that described in U.S. Pat. No. 4,728,006, but the invention may be applied to any dispensing spout where the size or configuration of the dispensing orifice relative to the viscosity of the bottle contents is such that venting is poor once the squeezing pressure has been released.

The present invention, by providing easier venting, thus allows much greater versatility in the selection of bottle material and design. Using the valve of the subject invention, a bottle is less reliant on the "return" or "memory" of the container walls for adequate venting.

The present invention thus provides a dispensing valve for a resilient deformable container having a rest position and a deformed dispensing position, comprising an outlet for permitting an egress of fluid from the container when the container is deformed under pressure, and venting means for permitting an ingress of air into the container when the pressure is removed, comprising a resilient flange surrounding the outlet and having an opening in fluid communication with the outlet when the container is in the deformed dispensing position, a resilient sealing surface of the flange abutting a seating surface when the flange is in a rest position, to prevent an egress of fluid between the sealing surface and the seating surface, and retaining means spaced about the flange retaining portions of the resilient sealing surface against the seating surface, whereby portions of the flange are able to deform away from the seating surface under the force of air sucked into the container as the pressure is removed and the container returns to its rest position, providing a path for the ingress of air into the container.

The present invention further provides a resilient deformable container having a rest position and a deformed dispensing position, having a dispensing valve comprising an outlet for permitting an egress of fluid from the container when the container is deformed under pressure, and venting means for permitting an ingress of air into the container when the pressure is removed, comprising a resilient flange surrounding the outlet and having an opening in fluid communication with the outlet when the container is in the deformed dispensing position, a resilient sealing surface of the flange abutting a seating surface when the flange is in a rest position, to prevent an egress of fluid between the sealing surface and the seating surface, and retaining means spaced about the flange retaining portions of the resilient sealing surface against the seating surface, whereby portions of the flange are able to deform away from the seating surface under the force of air sucked into the container as the pressure is removed and the container returns to its rest position, providing a path for the ingress of air into the container.

BRIEF DESCRIPTION OF THE DRAWINGS

In drawings which illustrate by way of example only a preferred embodiment of the invention.

DETAILED DESCRIPTION OF THE INVENTION

Figure 1:
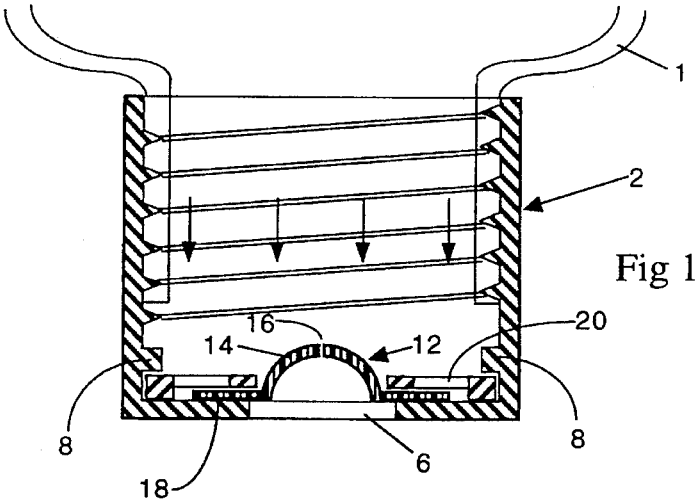
FIG. 1 is a cross-section of a container cap embodying the invention showing the position of the dispensing valve with the container in a rest position.
Figure 2:
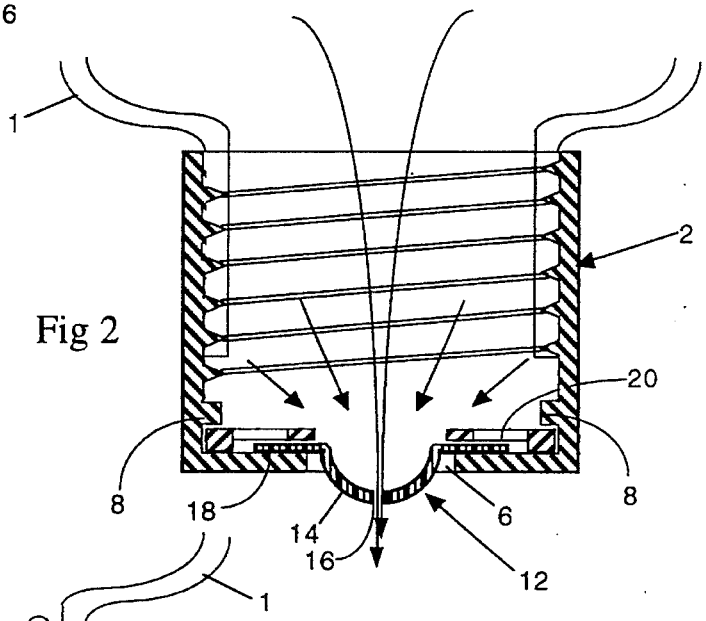
FIG. 2 is the cross-section of FIG. 1 showing the position of the valve when the container is compressed to a dispensing position.
Figure 3:
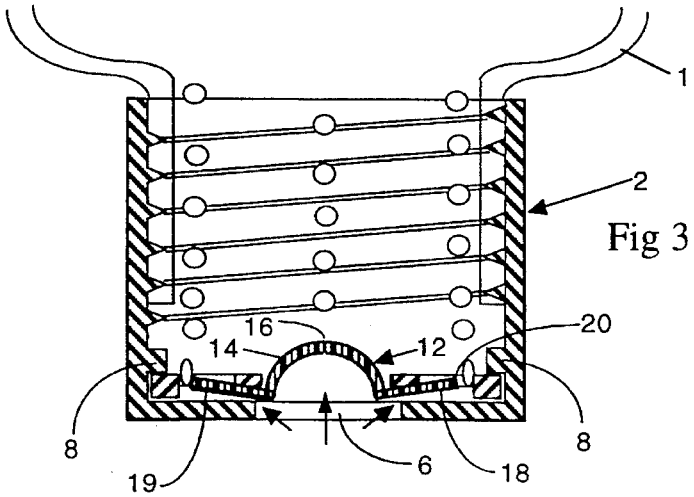
FIG. 3 is the cross-section of FIG. 1 showing the position of the valve when the container is returning to the rest position following the release of the compressive force.
Figure 4:
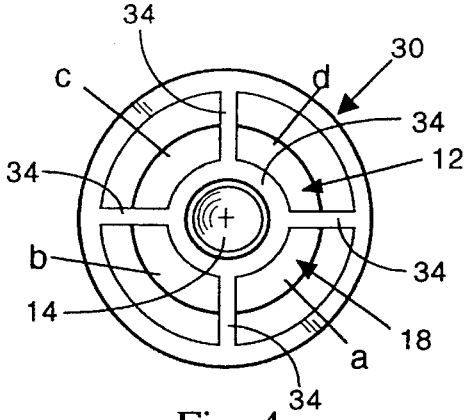
FIG. 4 is a top plan view of the dispensing valve shown in FIG. 1.

FIGS. 1–3 illustrate a closure member, in this case a conventional threaded bottle cap 2, attached to a container 1 containing a preferred embodiment of the dispensing valve 10 of the invention illustrated in plan view in FIG. 4. In one preferred embodiment the dispensing valve 10 includes the dome diaphragm of the dispensing valve described in U.S. Pat. No. 4,728,006, which is incorporated herein by reference, and in the dispensing operation works in the same fashion.

The diaphragm 12 of the subject invention thus comprises a resilient concave dome 14 having a slit or slits 16 through or about the apex of the dome 14, and a flange diaphragm 18 surrounding the dome 14, the purpose of which is described below. The edges of each slit 16, through which the fluid contents of the container are dispensed, abut one another when the dome diaphragm 14 is in the rest position, and are forced together by the weight of the fluid contents in the container.

The dome diaphragm 14 is preferably formed integrally with the flange diaphragm 18, moulded from a resilient material such as silicone or rubber. The flange diaphragm 18 has a planar sealing surface 19, and operates in a direction opposite that of the dome diaphragm 14 to permit an ingress of air into the container as the container resumes its undeformed rest position when the squeezing force is released.

In the embodiment shown in FIGS. 1–4, the flange diaphragm 18 is circular with a diameter smaller than that of the cap 2. The sealing surface 19 is the 10 bottom surface of the flange diaphragm 18 which rests against a planar seating surface 4, which in this case is the interior surface of the cap 2 surrounding the dispensing opening 6, which is larger than the diameter of the dome diaphragm 14. The seating surface 4 is preferably formed from a rigid material such as plastic.

A retaining ring 30 also formed from a rigid material such as plastic, consists of two concentric annular rings 32, 34 joined by retaining tabs 36, which snaps into the cap 2 over the diaphragm 12 and is retained therein by bosses 8 distributed around the cap interior. The flange diaphragm 18 is retained against the seating surface 4 only at the points beneath the retaining tabs 36, and the unrestrained portions a,b,c,d of the flange diaphragm 18 are free to deform inwardly into the container under the pressure of air being sucked into the container by the resilient walls as they return to the rest position. The centre ring 34 traps the dome diaphragm 14 and thus helps to keep the diaphragm 12 centred in the cap 2.

It is essential that only portions of the flange diaphragm 18 be retained against the seating surface 4 by the retaining ring 30; other portions of the flange diaphragm, designated a,b,c and d in FIG. 4, are seated against the seating surface 4 when the container is in the rest position (FIG. 1) or the compressed position (FIG. 2), but are not retained thereagainst by the retaining ring 30 and are thus free to deform away from the seating surface 4, as described below, when the container is returning to the rest position (FIG. 3). In this embodiment the retaining tabs 36 are sufficiently slender that the centre ring 34 can rise slightly under the influence of the pressure differential created by the walls of the container returning to their rest position. As seen in FIG. 3, this creates a gap between the sealing surface 19 and the seating surface 4 which allows the ingress of air into the container 1. Additionally, it will be noted that the outer ring 32 of the retaining ring 30 has a thickness which allows the inner ring 34 and retaining tabs 36 to be suspended slightly above the flange diaphragm 18, thus leaving some space for the flange diaphragm to rise under the influence of said pressure differential. However, the space into which the flange diaphragm 18 can rise should be minimal, to ensure that the diaphragm 12 does not float in the fluid in the container 1. It will be noted that the centre ring 34 encircles the dome diaphragm 14 in both the rest and venting positions, to keep the diaphragm 12 centred in the cap 2.

In another embodiment the periphery of the dispensing opening 6 may extend beyond the edges of the central portion of the retaining ring 30, so that the unrestrained portions a,b,c,d of the diaphragm 12 at least partially overlay the dispensing opening 6, providing a path for air to ingress into the container. In this embodiment the retaining ring 30 can be completely rigid.

FIG. 1 illustrates the valve 12 at rest, i.e., when the container is in the rest position and undeformed. During dispensing when a squeezing pressure is applied to the container, the diaphragm 14 operates in the same manner as the diaphragm described in U.S. Pat. No. 4,728,006. The compressive force of the fluid contents of the container against the dome diaphragm 14 eventually reaches a threshold at which point the dome diaphragm 14 inverts to a convex position, shown in FIG. 2. The pressure of the fluid as the container is squeezed forces the edges of the slit 16 apart to thus allow the fluid to be dispensed through the slit 16.

When the squeezing pressure on the container is released, the resilient walls of the container 1 try to return to their rest position. This creates a low pressure zone within the interior of the container 1, which first sucks the dome diaphragm 14 back into the concave position. However, because the opposing edges of the slit 16 naturally bear against one another in order to prevent leakage through the dome diaphragm 14, it is difficult for air to ingress into the container through the slit 16 to equalize the pressure differential; the pressure created by the container walls returning to the rest position is considerably less than the pressure created by manually squeezing the container.

According to the present invention, as shown in FIG. 3, as the walls of the container 1 try to return to their rest position air is sucked into the container 1 through the dispensing opening 6 and between the sealing surface 19 of the flange diaphragm 18 and the seating surface 4. Because the flange diaphragm 18 is resilient, those portions a,b,c,d of the flange diaphragm 18 which are not retained against the seating surface 4 by the retaining tabs 36 pucker or deform inwardly toward the interior of the container 1. In other words, the pressure imbalance created by the resilient container walls as they try to return to their rest position causes air to enter through the dispensing opening 6 and force the sealing surface 19 away from the seating surface 4, thus permitting the ingress of air into the container 1.

This venting action is far more effective than can be achieved through the slit 16 alone, both because of the relatively large area through which air can ingress into the container 1, which is the cumulative area defined by those portions a,b,c,d of the flange diaphragm 18 which are not retained against the seating surface 4, and because the unrestrained portions a,b,c,d of the flange diaphragm 18 are easier to deform than the edges of the slits 16.

The sealing surface 19 of the flange diaphragm 18 must abut a sufficient area of the seating surface 4 that the fluid in the container 1 will not leak out therebetween. In fact, gravity will cause the fluid contents of the container 1 to force the flange diaphragm 18 (and thus the sealing surface 19) against the seating surface 4, both in the rest position and particularly during the dispensing process where the squeezing force will be added to the force of gravity, which will assist in preventing leakage. It is necessary that the flange diaphragm 18 be retained at a sufficient number of points that it will not buckle, and three or four points evenly spaced around the periphery of the flange diaphragm 18 should be sufficient to accomplish this and still leave sufficient unrestrained portions of the flange diaphragm 18 to allow effective venting of the container 1.

Figure 5:
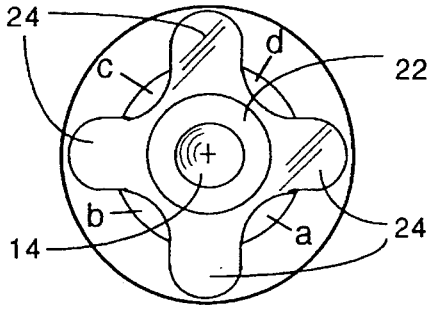
FIG. 5 is a top plan view of a further embodiment of the dispensing valve of the invention.
Figure 6:
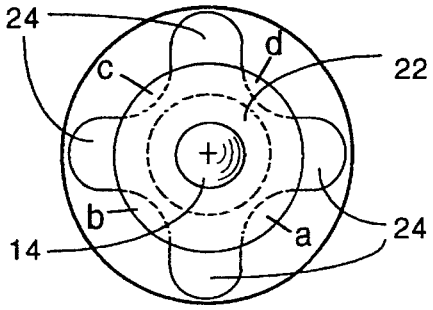
FIG. 6 is a bottom plan view of the valve of FIG. 5.

It will be appreciated that many different configurations of the flange diaphragm and the retaining ring are available. FIGS. 5 to 8 illustrate examples of further embodiments of the invention. In the embodiment of FIGS. 5 and 6 a retaining ring 20 comprises a circular opening 22 through which the dome diaphragm 14 projects when at rest, and four evenly spaced retaining tabs 24 sized so that opposed retaining tabs extend approximately across the interior of the cap 2. As in the previous embodiment, the retaining ring is snap-locked into the cap 2 above the diaphragm 12 by bosses 8 spaced around the interior of the wall of the cap 2. The circular opening 22 traps the dome diaphragm 14 in its rest position and thus helps to keep the diaphragm 12 centred in the cap 2.

Figure 7:
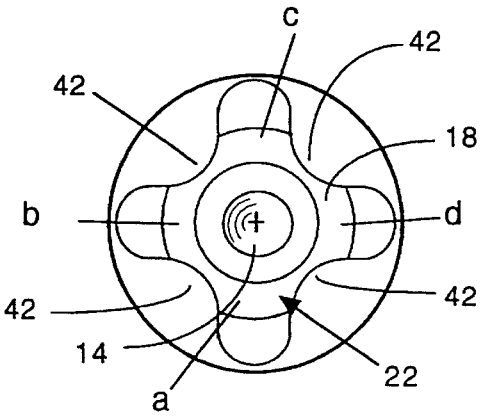
FIG. 7 is a top plan view of a still further embodiment of the dispensing valve of the invention.

FIG. 7 shows a still further embodiment of the invention, in which the flange diaphragm 18 is circular and a retaining ring 40 is provided with rounded retaining tabs 42 extending over portions of the flange diaphragm 18, again leaving unrestrained portions a,b,c,d of the flange diaphragm 18 free to move away from the seating surface 4 under the force of air being sucked into the container 1 as the walls return to their rest position.

Figure 8:
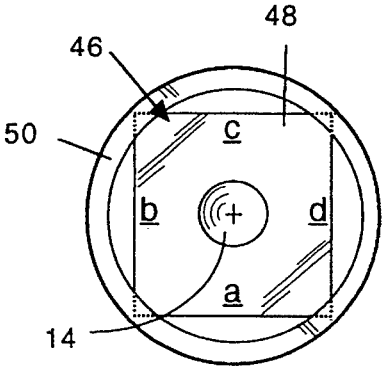
FIG. 8 is a top plan view of a still further embodiment of the dispensing valve of the invention.

FIG. 8 shows a still further embodiment of the invention, having a diaphragm 46 in which the flange diaphragm 48 is square with diagonally opposed corners extending substantially across the diameter of the cap 2. A retaining ring 50 is a simple annular ring overlaying corner portions of the flange diaphragm 48, leaving unrestrained portions a,b,c,d of the flange diaphragm 48 free to move away from the seating surface 4 under the force of air being sucked into the container 1 as the walls return to their rest position.

In the embodiments of FIGS. 7 and 8 the dispensing opening 6 can be made to be just slightly larger than the diameter of the dome diaphragm 14, because the retaining rings 40 and 50 restrain the flange diaphragm 18 or 48 only around its outer edge. Thus, the retaining rings 40 or 50 do not hold down the portion of the flange diaphragm 18 or 48 immediately surrounding the dome diaphragm 14, and the dome diaphragm 14 itself is free to deform toward the container 1 to permit an ingress of air through the dispensing opening 6. However, the respective retaining rings 40 and 50 must hold the edges of the flange diaphragm 18 or 48 tightly, so that the diaphragm 12 or 46 does not get sucked into the container 1 during venting.

Many other configurations of the invention are possible. For example, rather than using a separate retaining ring to hold down portions of the flange diaphragm, hooks or bosses may be formed into the cap 2 for this purpose. In the case of the square flange diaphragm 48, the lip of the bottle neck can be used as a retaining ring to retain the corners of the flange diaphragm 48. The common feature is that the retaining means, whatever its form, retains only portions of the flange diaphragm against the seating surface 4 while leaving portions of the flange diaphragm free to deform away from the seating surface 4 under the force of air ingressing into the container 1.

Figure 9:
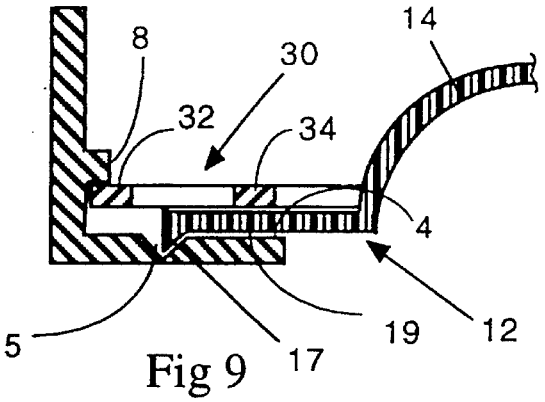
FIG. 9 is a partial cross-section of a cap embodying a still further embodiment of the invention.

FIG. 9 illustrates an embodiment in which the peripheral edge of the sealing surface 19 of the flange diaphragm 18 is provided with an annular foot 17, and the seating surface 4 is provided with a complementary annular channel 5 into which the foot 17 fits, not snugly but sufficiently closely to assist in preventing leakage of the fluid contents of the container between the sealing surface 18 and the seating surface 4. The valve otherwise operates as in the previous embodiments, but sufficient space must be available for the foot 17 to completely recede from the channel 5 to allow proper venting.

It will be apparent that the invention can be realized in many ways. While the invention has been illustrated by way of example in a container cap 2, it is also possible to configure the neck of the container 1 in such a way that the neck acts as a retaining ring and the flange diaphragm may be secured thereto by provisions such as hooks formed on the neck of the container, or by the cap.

Figure 10:
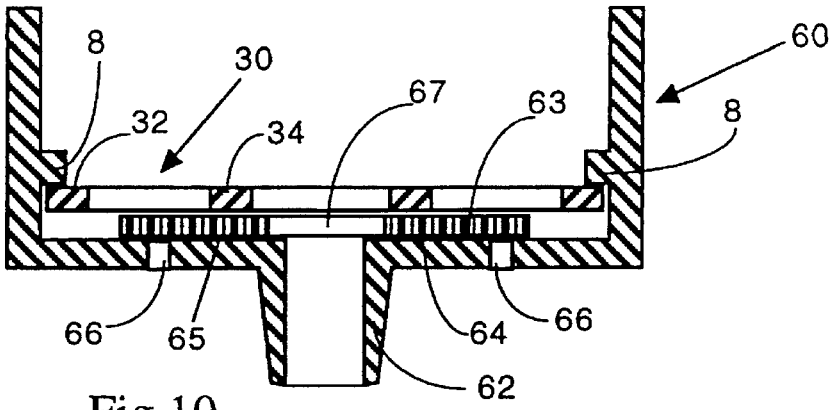
FIG. 10 is a cross-section of a cap having a conventional dispensing spout embodying a still further embodiment of the invention.

The invention has been described in the preferred embodiment, which combines the dome diaphragm of U.S. Pat. No. 4,728,006, for dispensing fluid from the container, with the flange diaphragm of the subject invention, for venting the container. It will be appreciated that the flange diaphragm can be combined with any other type of dispensing means, even a simple spout as illustrated in FIG. 10. So long as the flange diaphragm surrounds the dispensing means, the unrestrained portions of the flange diaphragm described herein will permit an effective ingress of air into the container, either as the sole venting means or to augment venting through the spout itself.

Figure 11:
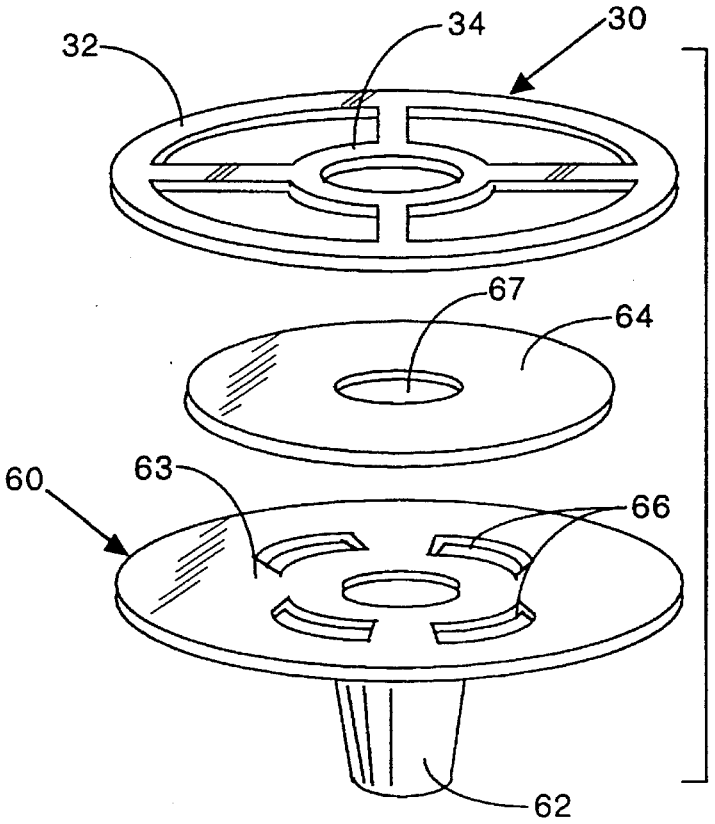
FIG. 11 is a perspective view of the valve in the embodiment of FIG. 10.

FIGS. 10 and 11 illustrate an embodiment of the invention for use in a cap 60 with a conventional tubular spout 62. The diaphragm 64 consists only of a resilient annular flange, with a central opening 67 and a sealing surface 65 retained against the seating surface 63 of the cap 60 by the retaining ring 30 of FIG. 6. Sealing means (not shown) fits over the spout 62 to close off the bottle. Because of its small diameter the spout 62 when stored and dispensing in the inverted position may not allow sufficient air ingress to properly vent the container. In this case, because the central ring 34 restrains the region of the diaphragm 64 immediately surrounding the spout 62, air ingress openings 66 through the cap 60 are arranged about the spout 62 under the unrestrained portions a,b,c,d of the diaphragm 64 beyond the edges of the central ring 34. The openings 66 allow air to enter through the cap 60 and cause the unrestrained portions of the diaphragm 64 to deform inwardly toward the container, thus improving venting as described above, particularly through very viscous fluids and gels. Larger air bubbles forming through such openings more readily rise through the fluid and fill the air pocket at the top of the container 1.

The invention having thus been described by way of example only, it will be apparent to those skilled in the art that various modifications and variations are available without departing from the scope of the invention, as set out in the appended claims.

I claim:

1. A dispensing valve for a resilient deformable container having a rest position and a deformed dispensing position, comprising an outlet for permitting an egress of fluid from the container when the container is deformed under pressure, and venting means for permitting an ingress of air into the container when the pressure is removed, comprising a resilient flange surrounding the outlet and having an opening in fluid communication with the outlet when the container is in the deformed dispensing position, a resilient sealing surface of the flange abutting a seating surface surrounding the outlet when the flange is in a rest position, to prevent an egress of fluid between the sealing surface and the seating surface, and retaining means comprising a retaining ring spaced about the flange, the retaining ring having a plurality of retaining tabs for retaining portions of the flange against the seating surface, whereby portions of the flange are able to deform away from the seating surface under the force of air sucked into the container as the pressure is removed and the container returns to its rest position, providing a path for the ingress of air into the container.

2. The valve of claim 1 in which the valve is contained within a cap for the container.

3. The valve of claim 2 in which the retaining ring is retained in the cap by bosses projecting from an inner wall of the cap.

4. The valve of claim 1 in which the resilient flange is attached to a resilient dome having an opening biased to a closed position, wherein the dome extends toward the container in a rest position and inverts when pressure is applied to the container to allow an egress of fluid from the container under pressure.

5. The valve of claim 4 in which the retaining ring includes a central opening which traps the dome in its rest position to assist in keeping the diaphragm centred about an opening of the container.

6. The valve of claim 2 in which the cap is provided with air ingress openings beneath deformable portions of the flange.

7. The valve of claim 1 in which the resilient sealing surface of the flange is provided with an annular foot and the seating surface is provided with a complementary channel whereby in the rest and dispensing positions the foot rests in the channel to resist leakage of the contents of the container.

8. The valve of claim 1 including four evenly spaced retaining tabs.

9. A resilient deformable container having a rest position and a deformed dispensing position, having a dispensing valve comprising an outlet for permitting an egress of fluid from the container when the container is deformed under pressure, and venting means for permitting an ingress of air into the container when the pressure is removed, comprising a resilient flange surrounding the outlet and having an opening in fluid communication with the outlet when the container is in the deformed dispensing position, a resilient sealing surface of the flange abutting a seating surface surrounding the outlet when the flange is in a rest position, to prevent an egress of fluid between the sealing surface and the seating surface, and retaining means comprising a retaining ring spaced about the flange, the retaining ring having a plurality of retaining tabs for retaining portions of the flange against the seating surface, whereby portions of the flange are able to deform away from the seating surface under the force of air sucked into the container as the pressure is removed and the container returns to its rest position, providing a path for the ingress of air into the container.

10. The container of claim 9 in which the valve is contained within a closure member of the container.

11. The container of claim 10 in which the retaining ring is retained in the closure member by bosses projecting from an inner wall of the closure member.

12. The container of claim 9 in which the resilient flange is attached to a resilient dome having an opening biased to a closed position, wherein the dome extends toward the container in a rest position and inverts when pressure is applied to the container to allow an egress of fluid from the container under pressure.

13. The container of claim 12 in which the retaining ring includes a central opening which traps the dome in its rest position to assist in keeping the diaphragm centred about an opening of the container.

14. The container of claim 10 in which the closure member is provided with air ingress openings beneath deformable portions of the flange.

15. The container of claim 9 in which the resilient sealing surface of the flange is provided with an annular foot and the seating surface is provided with a complementary channel whereby in the rest and dispensing positions the foot rests in the channel to resist leakage of the contents of the container.

16. The container of claim 9 including four evenly spaced retaining tabs.

17. A dispensing valve for a resilient deformable container having a rest position and a deformed dispensing position, comprising an outlet for permitting an egress of fluid from the container when the container is deformed under pressure, and venting means for permitting an ingress of air into the container when the pressure is removed, comprising a resilient flange surrounding the outlet and having an opening in fluid communication with the outlet when the container is in the deformed dispensing position, a resilient sealing surface of the flange abutting a seating surface surrounding the outlet when the flange is in a rest position, to prevent an egress of fluid between the sealing surface and the seating surface, and retaining means comprising a retaining ring spaced about the flange, the flange being attached to a resilient dome having an opening biased to a closed position, wherein the dome extends toward the container in a rest position and inverts when pressure is applied to the container to allow an egress of fluid form the container under pressure, whereby portions of the flange are able to deform away from the seating surface under the force of air sucked into the container as the pressure is removed and the container returns to its rest position, providing a path for the ingress of air into the container.

* * * * *